US005337501A

United States Patent [19]

Amanze

[11] Patent Number: 5,337,501

[45] Date of Patent: Aug. 16, 1994

[54] INTERLOCKING MEANS FOR MAGNETIC ALPHANUMERIC CHARACTERS

[76] Inventor: Charles U. Amanze, 14816 Dacosta St., Detroit, Mich. 48223

[21] Appl. No.: 909,582

[22] Filed: Jul. 6, 1992

[51] Int. Cl.[5] ..... G09F 7/04

[52] U.S. Cl. ..... 40/621; 273/239; 273/272; 434/168; 434/171; 434/172

[58] Field of Search ..... 40/600, 621, 595; 446/85, 92; 273/239, 272, 156, 157 R; 434/159, 167, 168, 171, 172, 406

[56] References Cited

U.S. PATENT DOCUMENTS

| | | | |
|---|---|---|---|
| 3,701,214 | 10/1972 | Sakamoto | 273/157 R X |
| 3,874,978 | 4/1975 | Naiman | 40/616 X |
| 4,361,328 | 11/1982 | Stein et al. | 434/406 X |
| 4,366,637 | 1/1983 | Dechamps | 40/621 |
| 5,203,847 | 4/1993 | Butt | 273/239 X |

FOREIGN PATENT DOCUMENTS

| | | | |
|---|---|---|---|
| 197004 | 7/1938 | Switzerland | 434/171 |
| 767299 | 1/1957 | United Kingdom | 434/159 |
| 842480 | 7/1960 | United Kingdom | 40/621 |

*Primary Examiner*—Brian K. Green

[57] ABSTRACT

Magnetic alphanumeric characters having substantially the capability to be properly aligned to one another during display is proposed. The characters consist of magnetic materials with concentrated magnetic strength on one face. The magnetized face is glued to a thin transparent polyethelene material whose edges are cut in a zig-zag fashion. The zig-zag edges allow more than one alphanumeric character to be installed in a straight line vertically, horizontally and at an angle.

1 Claim, 1 Drawing Sheet

INTERLOCKING MEANS FOR MAGNETIC ALPHANUMERIC CHARACTERS

BACKGROUND OF THE INVENTION

1. Field of The Invention

The present invention relates generally to alphanumeric characters made of magnetic materials. More particularly, the present invention relates to a means for properly aligning flexible magnetic alphanumeric characters including and not limited to punctuations, simple shapes and figures that could be arranged to form words, phrases, sentences, selected patterns and a combination thereof.

2. Background of The Arts

When conveying and exchanging written information, alphanumeric characters are arranged to form words, phrases, sentences, figures, patterns, etc. Often, these groups of characters need to be changed and updated. It is also often necessary to be able to continually adapt the information to particular requirements and sizes; this would require a large stock of both background and foreground materials, most of which will be discarded after each use. This use and discard approach is environmentally inefficient and it is this inefficiency that my present invention is designed to address.

It will be seen that the alphanumeric characters in my present invention can be replaced and reused as many times as desired and also form words and/or phrases while assembled in a straight line.

Several proposals for displaying magnetic alphanumeric characters have been disclosed such as those shown in U.S. Pat. No. 4,583,312 and 3,988,845. While the devices shown in these inventions can be used for alphanumeric character displays, they are generally designed such that one alphanumeric character is formed by several pieces of magnetic parts. A considerable amount of time is spent in getting these several parts to form one character. Further, U.S. Pat. No. 4,583,312 is suitable only for numeric characters and cannot be adequately used for alphabetic characters and punctuations.

It would therefore be highly desirable to have a set of alphanumeric characters that would properly attach to a metallic surface and also align with other characters to form words, phrases, sentences, figures, patterns, etc.

DISCLOSURE OF THE INVENTION

It is the object of this invention to overcome the short comings of prior designs and to improve the display of alphanumeric characters using magnetic materials of the type mentioned initially such that visual information is conveyed quickly, easily and more efficiently.

Another object of the present invention is the use of magnetic alphanumeric characters which are light in weight and; that can attach to a moving or stationary metallic surface.

Yet another object of this invention consists of the provision of magnetic alphanumeric characters of various sizes, fonts and colors.

A further object of this invention is that the magnetic alphanumeric characters are glued unto a thin transparent polyethylene material that forms a part thereof, such that, words, phrases and sentences formed by any set of characters would maintain a straight line upon display; the edges of the said transparent polyethylene backing serve as a guide, ensuring that the characters all fall in a straight line.

It is even further the object of this invention to provide magnetic alphanumeric characters such that when the characters are displayed on a metallic surface, the background in the proximity of the said character is not obscured.

Details of the alphanumeric characters with the aligning transparent polyethylene backing and further objects and advantages thereof will become evident as the description proceeds and from an explanation of the accompanying one sheet of drawing.

BRIEF DESCRIPTION OF THE DRAWINGS

The drawings illustrate a preferred embodiment of the invention with similar numericals referring to similar parts throughout the several views, herein.

DETAILED DESCRIPTION OF THE PREFERRED EMBODIMENTS

Figure 1:
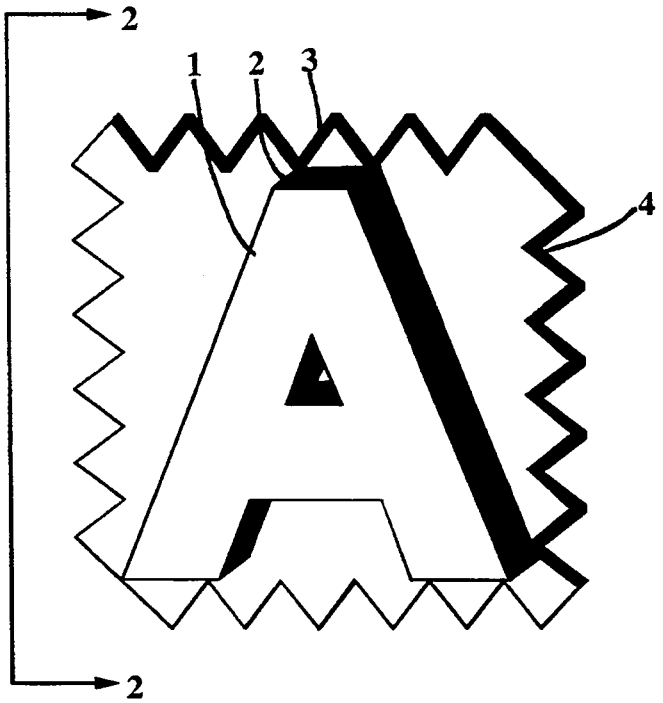
FIG. 1 is a perspective view of one character of the subject invention.
Figure 2:
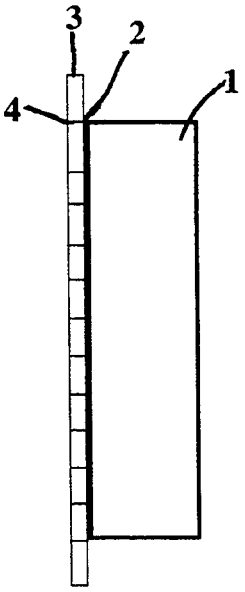
FIG. 2 shows a side view illustration of the subject invention.
Figure 3:
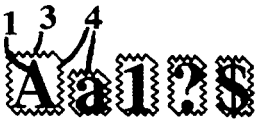
FIG. 3 shows a front view of a few of many magnetic alphanumeric characters of the subject invention.
Figure 4:
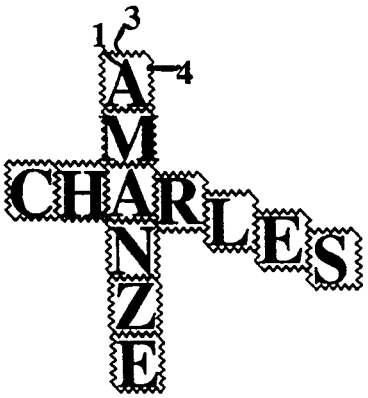
FIG. 4 is the subject invention used to form words.

The embodiment shown in FIGS. 1, 2, 3 and 4 includes a magnetic character 1 preferably made of flexible magnetic rubber. The magnetic face 2 of the flexible magnetic rubber 1 is attached to a thin transparent polyethylene sheet 3, preferably the static-cling type, with the aid of glue. The edges 4 of the thin polyethylene material 3 are shaped in a zig-zag fashion to enable more than one assembly to be aligned during display.

While the preferred embodiment has been illustrated and explained hereinabove, it should be understood that further variations will be apparent to those skilled in the art without departure from the principles of the invention, which, while other embodiments are possible, their variations from the preferred embodiment cannot be viewed as fundamental.

I claim:

1. A magnetic alphanumeric character comprising:

a magnetic faced member having an alphanumeric shape being adhered to a thin transparent backing material;

said thin transparent backing material having edges with a plurality of grooves in each of said edges for interlocking with an edge of another magnetic alphanumeric character at one of a plurality of positions along one of said edges of said transparent backing material.

* * * * *